United States Patent [19]

Darby et al.

[11] 4,060,581

[45] Nov. 29, 1977

[54] METHOD OF MAKING A COMPOSITE BURIAL VAULT

[76] Inventors: David L. Darby, 501 Brickyard Road; James W. Darby, 2117 Smith, both of Danville, Ill. 61832

[21] Appl. No.: 522,133

[22] Filed: Nov. 8, 1974

[51] Int. Cl.[2] ..... B28B 11/06

[52] U.S. Cl. ..... 264/131; 52/135; 264/256; 264/274; 264/343

[58] Field of Search ..... 264/256, 274, 131, 343; 52/135

[56] References Cited

U.S. PATENT DOCUMENTS

| | | | |
|---|---|---|---|
| 1,286,542 | 12/1918 | Crigler | 52/128 |
| 1,499,719 | 7/1924 | Bille | 264/256 |
| 1,729,172 | 9/1929 | Lundin | 264/256 |
| 2,721,369 | 10/1955 | Burke | 264/256 |
| 3,332,499 | 7/1967 | Harris et al. | 264/256 |
| 3,433,284 | 3/1969 | Webbere et al. | 264/274 |
| 3,436,442 | 4/1969 | Saks | 264/131 X |
| 3,787,545 | 1/1974 | Chandler et al. | 264/256 |
| 3,839,768 | 10/1974 | McQuestion | 52/135 X |
| 3,864,443 | 2/1975 | Hopkins | 264/131 X |

FOREIGN PATENT DOCUMENTS

| | | | |
|---|---|---|---|
| 228,233 | 4/1960 | Australia | 264/131 |

*Primary Examiner*—Thomas P. Pavelko

*Attorney, Agent, or Firm*—Gifford, Chandler, Sheridan & Sprinkle

[57] ABSTRACT

A composite burial vault is provided having a hollow liner constructed of a synthetic plastic resinous material which is filled with concrete. In constructing the burial vault, the liner is constructed from thermosetting resinous material in any conventional method. While the liner is still wet, aggregate is applied to the surface of the liner by a flocking gun or the like. Concrete is then poured between a mold and the treated surface of the liner where it forms a mechanical bond to the coarse aggregate coating on the liner.

5 Claims, 6 Drawing Figures

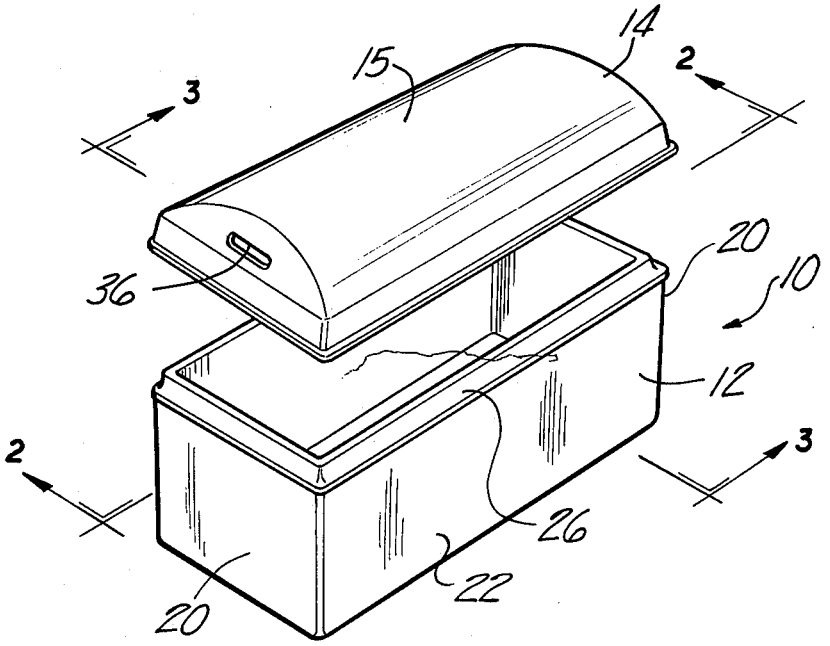
Fig-1
Fig-2
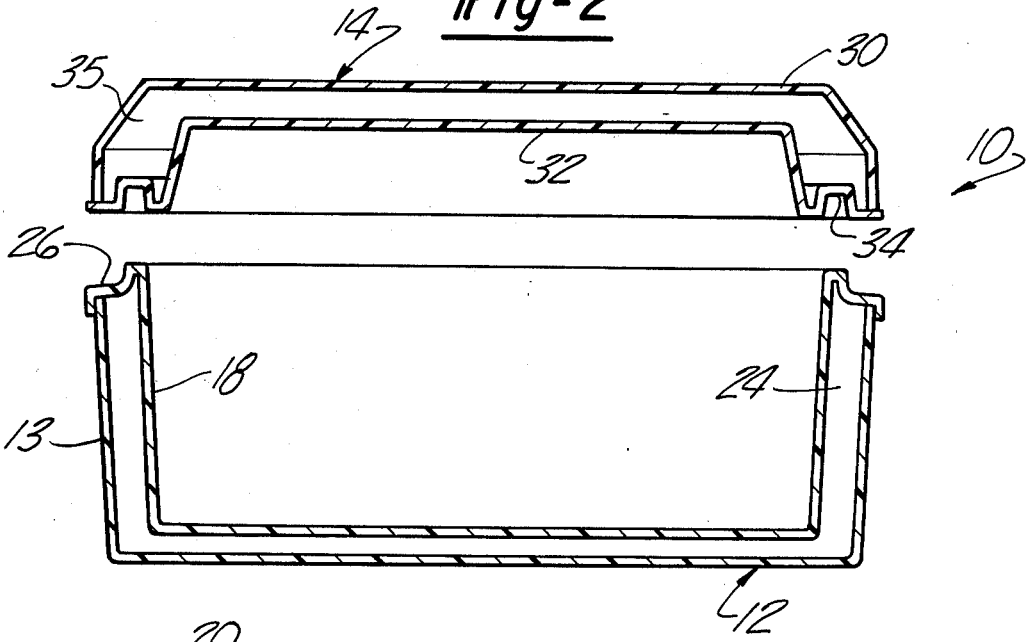
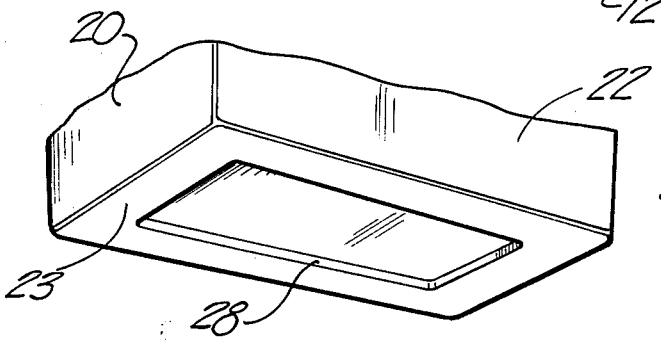
Fig-4

METHOD OF MAKING A COMPOSITE BURIAL VAULT

BACKGROUND OF THE INVENTION

I. Field of the Invention

The present invention relates to burial vaults, and, more particularly, to a composite burial vault comprising a plastic resinous liner with a concrete mechanically bonded to one surface thereof.

II. Description of the Prior Art

Composite burial vaults, such as that described in U.S. Pat. No. 3,439,461 issued to Chandler et al on Apr. 22, 1969, are relatively new in the field. Such burial vaults typically comprise a plastic resinous liner which is coated first wtih an adhesive and then with concrete. Such composite burial vaults have been found to be advantageous in that the concrete provides structural rigidity, while the plastic resinous liner if it is exterior of the concrete provides a water resistant wall unlike the more porous cement.

In some arrangements, the liner is for appearance and protection disposed interiorly of the burial vault. In still other arrangements, a resinous inner and resinous outer liner are provided with the concrete formed therebetween. Although such composite burial vaults have been well accepted in the trade, such burial vaults also have disadvantages of which it is the object of the present invention to eliminate.

The primary disadvantage with the prior art composite burial vaults is that an adhesive must be applied to the liner prior to pouring the concrete into the mold. The adhesive is not only expensive to purchase, but also is expensive to apply to the liner in that typically twenty to thirty minutes are required to completely coat the liner with the adhesive. A further disadvantage of the use of an adhesive between the liner and the concrete is that when the wet concrete is poured against the tacky adhesive, the concrete flow tends to rub the adhesive off the liner. When the adhesive is removed by the concrete flow, only a loose, and therefore undesirable, bond is formed between the liner and the concrete.

Another problem with the previously known liner-adhesive-concrete bond in a composite burial vault is that such a bond requires a relatively high amount of water for the liner-adhesive bond. It has been found that thermal expansion and contraction of the bond will often crack the resinous liner, both before and after the burial vault is finally placed into the ground. A cracked burial vault functions ineffectively and is therefore undesirable.

An associated problem has arisen as the use of composite burial vaults have become more widespread. Namely, various companies have developed and manufacture vacuum formed resinous liners and sell such liners to funeral homes, cemeteries, or the like. The composite burial vaults are assembled by the purchaser after the liner is received by the purchaser. The vacuum formed liners, however, are brittle and often break or crack en route to their destination. The high breakage rate of vacuum formed liners is very undesirable and unnecessarily increases the cost of the composite burial vault.

SUMMARY OF THE INVENTION

The present invention eliminates the above mentioned disadvantages of the previously known composite burial vaults by eliminating the liner-adhesive-concrete bond in the burial vault and substituting a mechanical bond thereinstead. In the preferred form of the invention, a resinous liner is constructed from wet, thermosetting resin in a conventional manner known in the trade. While the resinous liner is still wet and tacky, aggregate is applied to the resinous liner by a flocking gun or any other suitable means. Thus, when the resinous liner dries, the aggregate is partially embedded in the liner and provides a coarse finish on the surface of the liner.

When final assembly of the composite burial vault of the present invention is desired, concrete is simply poured into the space provided between a mold and the treated surface of the liner where it bonds to the coarse aggregate finish on the liner. A three-dimensional mechanical bond rather than a glued bond is thus provided between the concrete and the aggregate, thereby eliminating the necessity of applying an adhesive to the resinous liner.

A modification of the present invention is also described for use primarily with a preformed vacuum formed liner. An adhesive, or a material which softens the resinous liner, is applied to the liner and the liner is then covered with aggregate by a flocking gun or the like. When the liner or the adhesive dries, the aggregate provides a coarse finish on the liner ready to receive concrete, as has been already described. An additional advantage of coating a vaccum formed liner with aggregate is that it has been discovered that the aggregate covered liners are much more resistant to breakage during transit than uncoated liners. Additional aggregate may also be coated onto a weak spot on the liner, thereby strengthening the liner at that particular weak spot.

BRIEF DESCRIPTION OF THE DRAWINGS

The composite burial vault of the present invention will be more clearly understood by reference to the following detailed description when read in conjunction with the accompanying drawing wherein like reference characters refer to like parts throughout the several views, and in which:

FIG. 1 is a perspective view showing the composite burial vault of the present invention;

FIG. 2 is a side cross-sectional view taken substantially along line 2—2 in FIG. 1;

FIG. 4 is a bottom perspective view showing the base of the burial vault of the present invention;

DETAILED DESCRIPTION OF THE INVENTION

Figure 3:
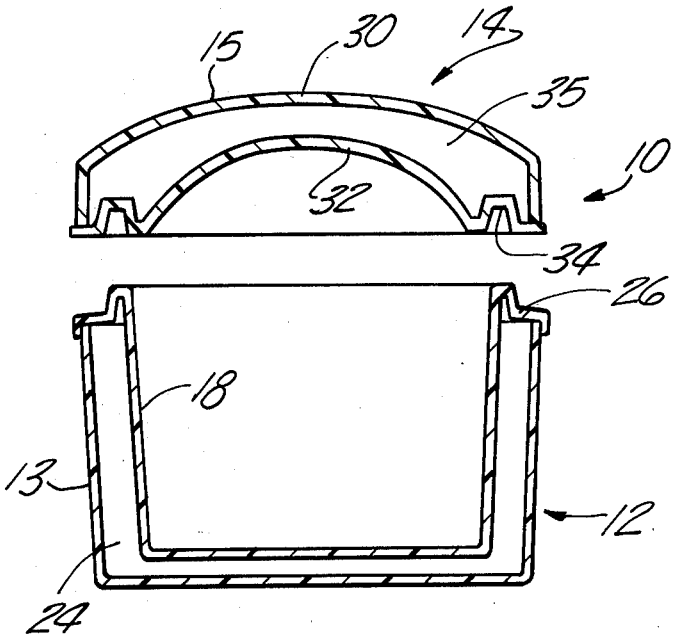
FIG. 3 is a cross-sectional view taken substantially along line 3—3 in FIG. 1.

The composite burial vault 10 of the present invention generally comprises a lower box or base portion 12 and an upper lid portion 14. The base portion 12 comprises an outer wall portion 13 having opposing end walls 20, opposing side walls 22, and a bottom 23. As shown in FIGS. 2 and 3, the base portion 12 further comprises an inner wall portion 18 which is also preferably constructed of a synthetic plastic resinous material. The inner wall portion 18 is spaced inwardly from and substantially parallel to the outer wall portion 13 so that a cavity 24 is formed between the outer wall portion 13 and the inner wall portion 18 around the entire periphery of the base portion 12. A web 26 is preferably provided across the upper open end of the inner wall portion 18 and the outer wall portion 13 and preferably the web 26 is constructed of the same material as the wall portions 13 and 18. The inner wall portion 18, the outer wall portion 13, and the web 26 may also be of integral construction. As can best be seen in FIG. 4, a rectangular aperture 28 is provided in the bottom 23 of the outer wall portion 13 in the base portion 12 for a purpose to be hereinafter described.

The lid 14 of the burial vault 10 is constructed in a similar manner as the base portion 12. Specifically, the lid 14 generally comprises a lid liner 15 having an outer wall 30 and an inwardly spaced inner wall 32, both of which are preferably constructed of a synthetic resinous material. A web 34 adapted to register with the web 26 is provided between the downwardly extending open end of the wall portions 30 and 32, so that a cavity 35 is formed within the lid liner 15. An aperture 36 is provided through the outer wall portion 30 of the lid liner 15 at one end of the lid 14 for a purpose to be shortly described.

Figure 5:
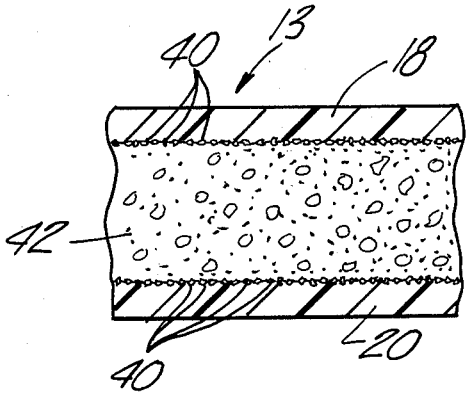
FIG. 5 is a partial cross-sectional view showing the bond between the liner and the cement and enlarged for clarity.

The method of constructing the base 12 of the burial vault 10 is as follows: The base 12 is constructed from a thermosetting resin. While the resin is still wet and tacky, the interior surface of the cavity 24 (FIG. 2) is covered with a granular material 40 (FIG. 5), hereinafter referred to as aggregate, preferably by a flocking gun, although any other means may be used. In this manner, the aggregate 40 is partially embedded in the resinous base 12 (FIG. 5) so that when the resin dries, the aggregate 40 will form a coarse coating or finish on the entire surface of the cavity 24. At any time subsequent to when the resin dries, a flowable concrete component 42 is poured through the aperture 28 in the bottom 23 of the base 12. The concrete 42 will fill the entire cavity 24 and form a mechanical bond as it dries between the concrete 42 and the wall portions 13 and 18. It has been found that a strong mechanical bond is formed between the concrete 42 and the wall portions 13 and 18 of the base 12 as the cement dries, thereby eliminating the necessity for applying an adhesive to the lining of the cavity 24.

The construction of the lid 14 is substantially identical to the construction of the base 12. Namely, the wall portions 30 and 32 of the lid liner 15 are constructed of thermosetting plastic resin and while still wet, aggregate is applied to the lining of the cavity 35 formed between the wall portions 30 and 32. The aggregate 40 is thus embedded in the resin and provides a coarse surface on the inner lining of the cavity 35 as the resin dries. Concrete is then poured through the aperture 36 (FIG. 1) in the outer wall portion 30 of the lid liner 15, and bonds to the coarse inner surface of the wall portions 30 and 32 in substantially the same manner as described above for the base 12.

It can thus be seen that by applying aggregate to the liner of the burial vault while the thermosetting resin is still wet and tacky, an adhesive, as previously known in the trade, is no longer required between the liner and the concrete. It has also been found that the mechanical bond between the concrete and the coarse aggregate coating on the liner provides a bond superior in strength to the previously known liner-adhesive-concrete bond.

A modification of the present invention must, however, be utilized when the synthetic resin liner is vacuum formed or preformed. Typically, such burial vault liners are completely dry when they are received or acquired. Thus, aggregate may not be applied to the liner as hereinabove described. However, while still remaining within the scope and spirit of the present invention, a solvent may be applied to the lining of the cavities 24 and 35 of the base and lid liners of the burial vault 10, thus rendering the resinous liner soft and tacky. Aggregate is applied to the liner so that the aggregate becomes partially embedded in the liner. Thus, when the solvent dries, a coarse coating of aggregate is provided on the liner, which is then ready to receive the concrete as previously described.

Figure 6:
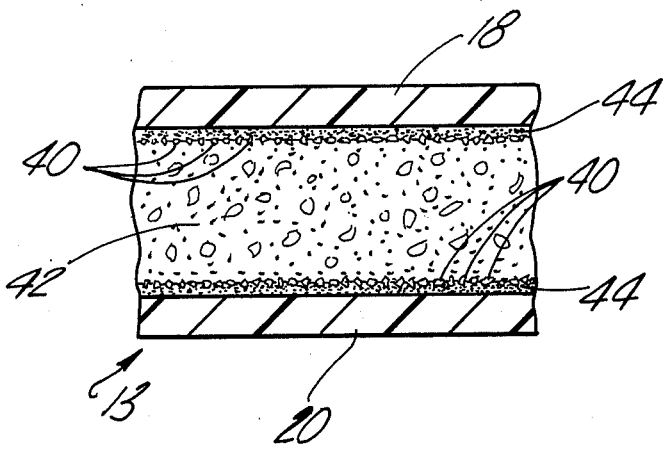
FIG. 6 is a view similar to FIG. 5 but showing a modification thereof.

Alternately, an adhesive 44 (FIG. 6) may be applied to the lining and then covered with aggregate 40 so that the adhesive 44 forms a bond between the liner 13 and the aggregate 40. When the adhesive 44 dries, the liner is again ready to receive the concrete component 42 as described hereinabove. It is to be understood, however, that in this last mentioned modification of the present invention, the adhesive 44 forms a bond between the liner wall and the aggregate 40 and not between the liner and concrete as known and described in the prior art. Thus, the previously known problem of the wet concrete rubbing off the adhesive from the liner is avoided by this last mentioned modification.

It should be understood that although a double wall base 12 and lid 15 have been described, commonly known burial vaults are provided with only an inner liner corresponding to the inner liner portion 18 or an outer liner corresponding to the outer liner portion 13. In such a construction, aggregate is applied to one side of the liner while the liner is still wet and tacky as previously described. Which side of the liner that the aggregate is applied will, of course, depend upon whether the liner is an inner liner or an outer liner. After the liner has dried, concrete is applied, preferably by using a mold, to the aggregate coated side of the liner to complete the burial vault.

It has been found that by coating a liner with aggregate, the liner is greatly strengthened. Since liners are typically shipped to cemeteries and the like and are there coated or filled with concrete, the present invention thus provides an additional advantage that the previously known high incidence of breakage of vacuum formed liners is greatly reduced by utilization of the present invention. The present invention also enjoys the additional advantage that multiple coats of aggregate may be applied to strengthen particularly weak spots in the liner, thereby preventing breakage at those points.

Having thus described our invention, many modifications thereto will become apparent to those skilled in the art without deviating from the spirit of the invention as defined by the scope of the appended claims.

What is claimed is:

1. The method of forming a composite burial vault comprising the steps of:

constructing a self supporting liner of thermosetting plastic resinous material, while said liner is drying and before it has set, applying a granular material to at least one surface of said liner, said granular material being applied to substantially all of said surface, whereby when said liner has dried said granular material will be embedded in said surface;

after said liner has dried with said granular material embedded therein, pouring a flowable concrete material into contact with said surface and said granular material and permitting said concrete material to dry whereby said granular material will act as a mechanical bond between said liner and said hardened concrete.

2. The method as defined in claim 1 and in which there is sufficient time lag between the time said granular material has been embedded into said liner and the time said concrete material has been bonded to said liner to permit transportation and storage of said liner.

3. The method as defined in claim 1 wherein said granular material is aggregate.

4. The method of forming a composite burial vault comprising the steps:

constructing a self supporting liner of plastic resinous material, after said liner has been formed, applying a solvent to at least one surface of said liner to thereby temporarily soften the surface, while said liner is soft and before it has hardened again, applying a granular material to said softened surface of said liner, said granular material being applied to substantially all of said surface, whereby when said liner has dried said granular material will be embedded into said surface of said liner, after said liner has dried with said granular material embedded therein, pouring a flowable concrete material into contact with said surface and said granular material and permitting said concrete material to dry whereby said granular material will act as a mechanical bond between said liner and said hardened concrete.

5. The method as defined in claim 4 and in which there is sufficient time lag between the time said granular material has been embedded into said liner and the time said concrete material has been bonded to said liner to permit transportation and storage of said liner.

* * * * *